US007128614B1

(12) United States Patent
Wu

(10) Patent No.: US 7,128,614 B1
(45) Date of Patent: Oct. 31, 2006

(54) ELECTRICAL ADAPTER WITH REINFORCING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/144,114

(22) Filed: Jun. 3, 2005

(51) Int. Cl.
*H01R 33/94* (2006.01)

(52) U.S. Cl. ..... 439/638; 439/607

(58) Field of Classification Search ..... 439/67, 439/77, 493, 502, 607–610, 638
See application file for complete search history.

(56) References Cited

U.S. PATENT DOCUMENTS 5,816,861 A * 10/1998 Cheng ..... 439/653
6,050,831 A * 4/2000 Wu et al. ..... 439/76.1
6,796,844 B1 * 9/2004 Edwards, III ..... 439/638
6,881,098 B1 * 4/2005 Jeansonne et al. ..... 439/638
6,890,206 B1 * 5/2005 Distad et al. ..... 439/372
6,923,683 B1 * 8/2005 Dulai et al. ..... 439/638
6,939,177 B1 * 9/2005 Kato et al. ..... 439/638
6,948,949 B1 * 9/2005 Schwartz et al. ..... 439/76.1

* cited by examiner

*Primary Examiner*—Khiem Nguyen
(74) *Attorney, Agent, or Firm*—Wei Te Chung

(57) ABSTRACT

An electrical adapter (500) for high-speed transmission includes a first connector part (1) defining a first mating port (100), a second connector part (2) defining a second mating port (200) different from the first mating port, a circuit substrate (20) having circuit traces thereon electrically connecting to the first and the second mating ports, and a reinforcing member assembled to the circuit substrate so as to provide mechanical constrain for mating/unmating of one of the first and the second connector parts.

8 Claims, 8 Drawing Sheets

ELECTRICAL ADAPTER WITH REINFORCING MEMBER

BACKGROUND OF THE INVENTION

1. Field of the Invention

The present invention generally relates to an electrical adapter, and more particularly to an electrical adapter used for high-density, high-speed transmission.

2. Description of Related Art

It is well known that electrical adapters are used in systems for electrically connecting two or more connectors which are complied with different standards. In recent years, the high-density, high-speed backplane connectors are widely used in network, server and storage applications for high-speed data process. In some applications, an electrical adapter with high speed is needed to connect an external system with an internal system, which have different specifications. Generally, the electrical adapter of this kind comprises two backplane connectors of different types so as to mate with corresponding complementary connectors assembled on internal/external systems, respectively. A stamped cover is commonly provided for shielding purpose. The two backplane connectors are electrically connected with each other via cable or circuit board received in the cover. However, the electrical connection between the circuit board and the backplane connectors is easy to be damaged due to frequent mated/unmated of the electrical adapter.

Hence, an improved electrical adapter is highly desired to overcome the disadvantages of the related art.

SUMMARY OF THE INVENTION

Accordingly, an object of the present invention is to provide an electrical adapter having a reinforcing member for mechanically constraining mated/unmated of the electrical adapter.

In order to achieve the object set forth, an electrical adapter in accordance with present invention comprises a first connector part defining a first mating port, a second connector part defining a second mating port different from the first mating port, a circuit substrate having circuit traces thereon electrically connecting to the first and the second mating ports, and a reinforcing member assembled to the circuit substrate so as to provide mechanical constrain for mating/unmating of one of the first and the second connector parts.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
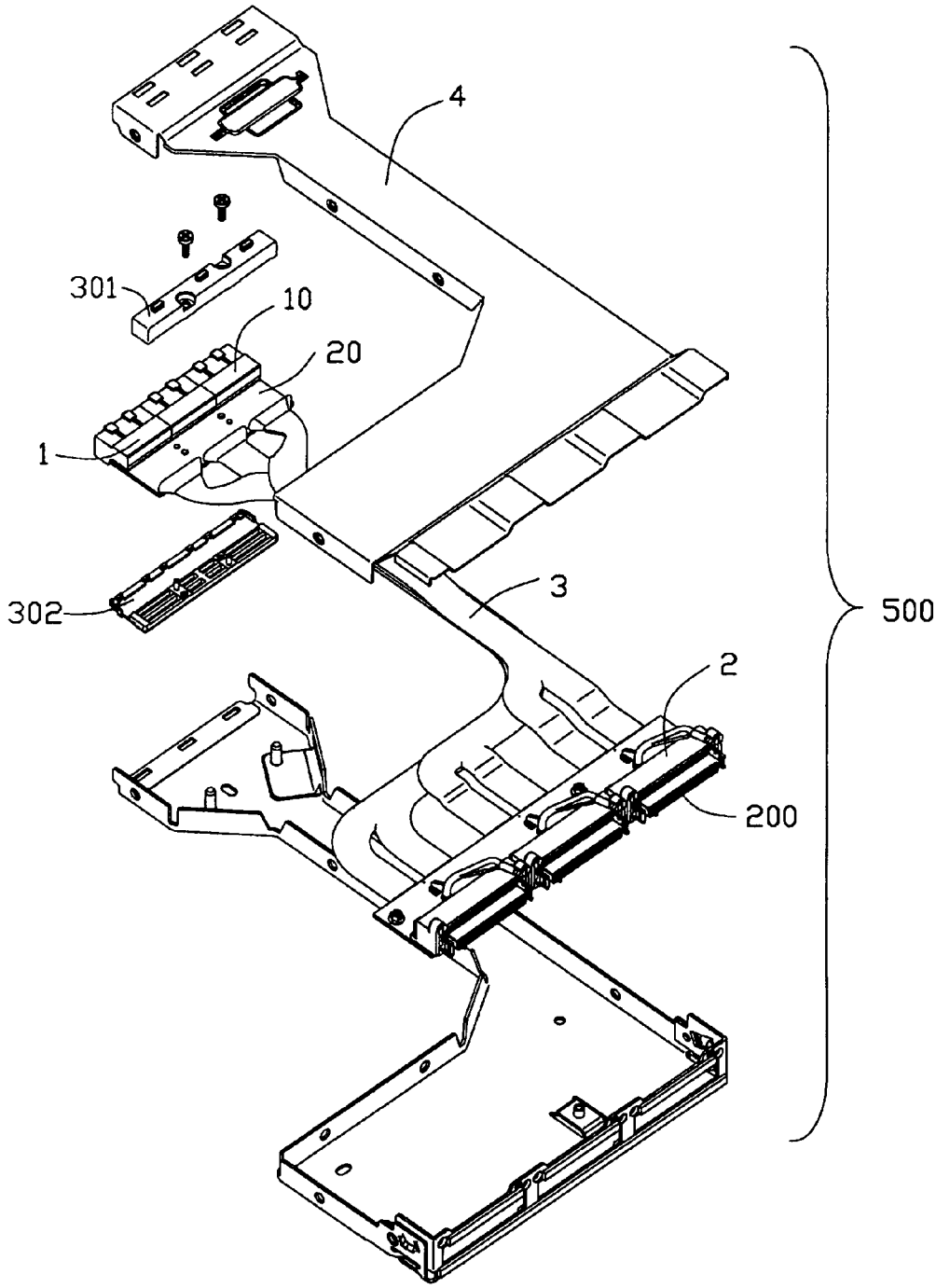
FIG. 1 is a partially exploded, perspective view of an electrical adapter in accordance with the present invention.
Figure 2:
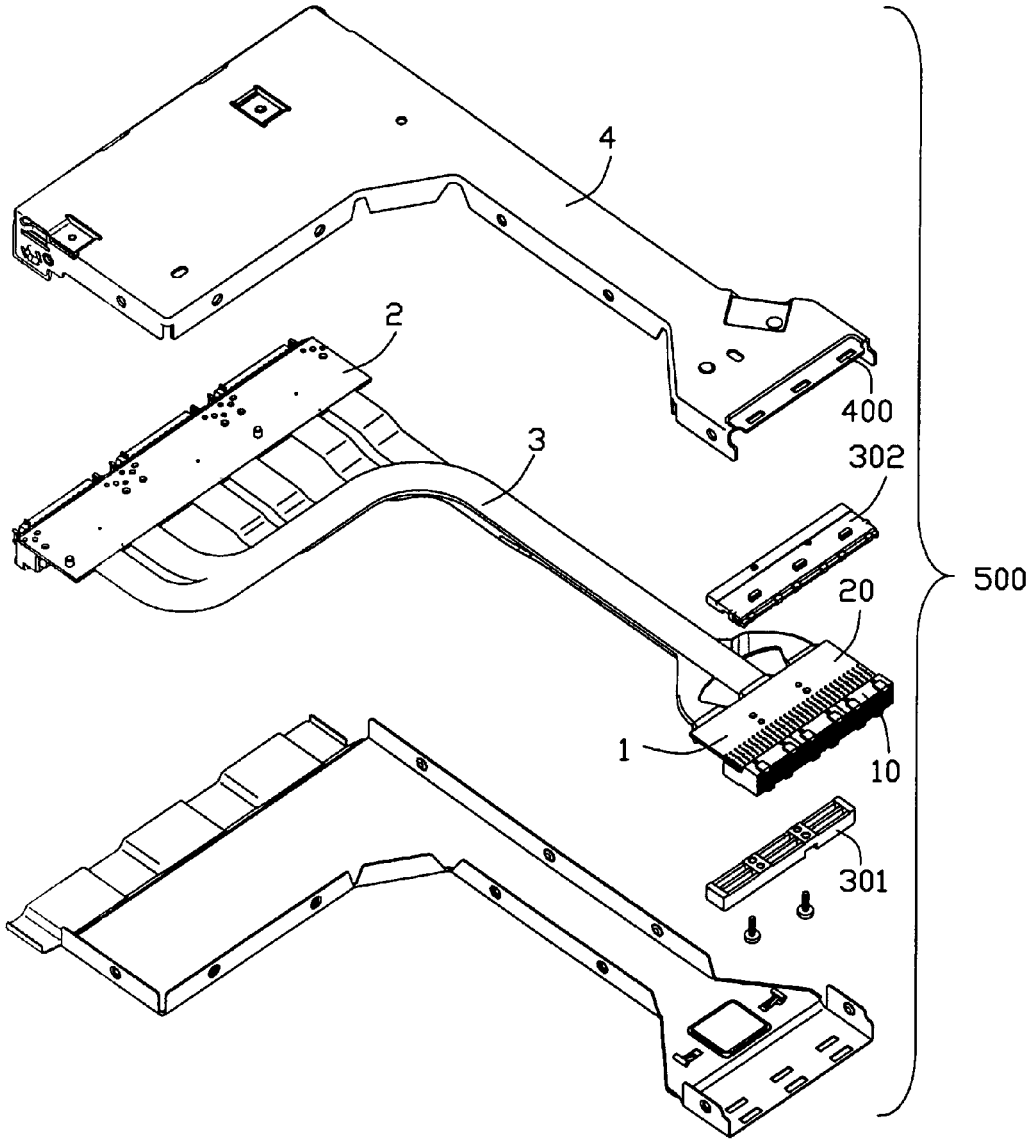
FIG. 2 is a view similar to FIG. 1, but viewed from another aspect.
Figure 3:
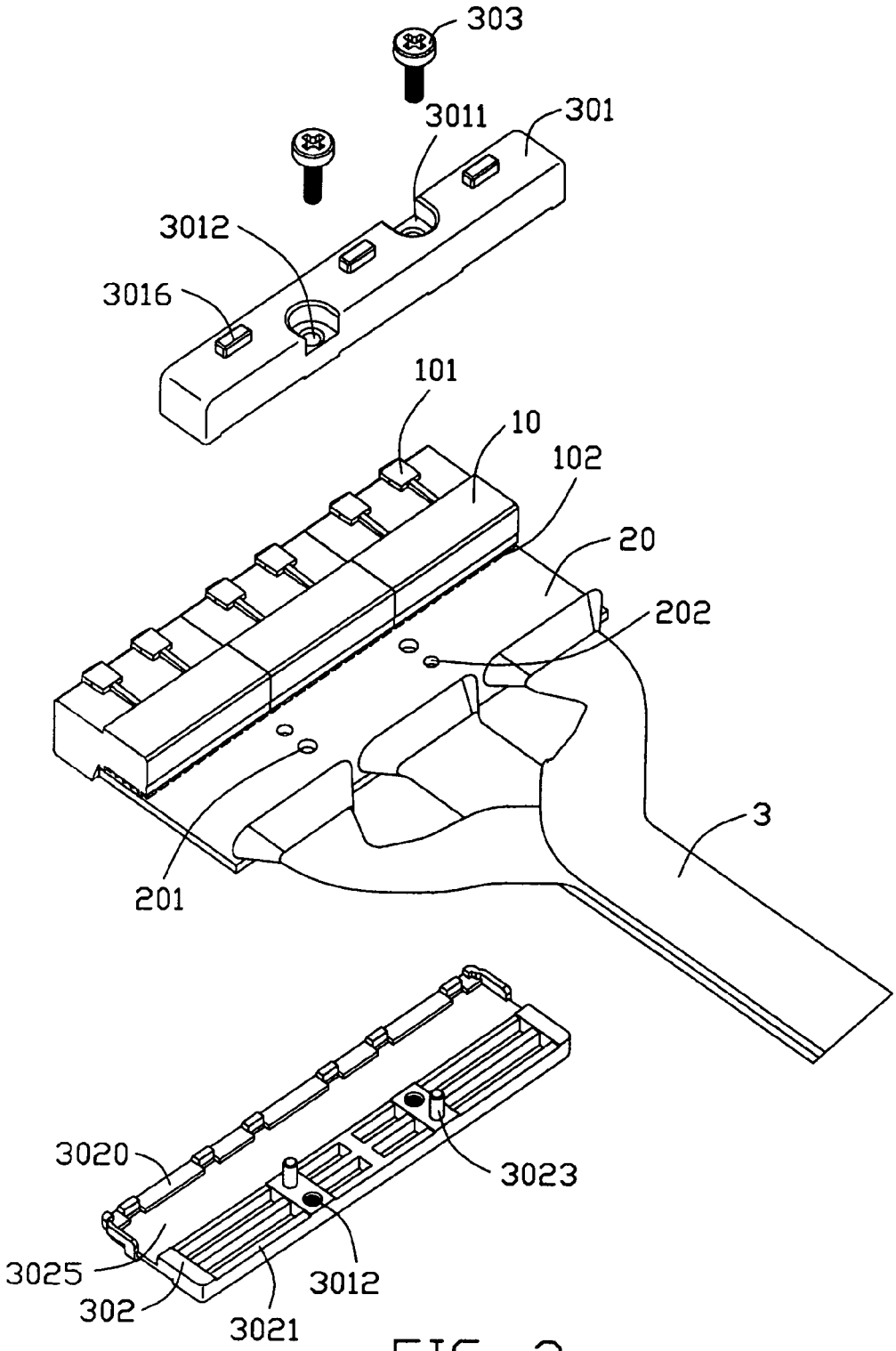
FIG. 3 is an enlarged view of a first connecting part connected with cable means shown in FIG. 1.
Figure 4:
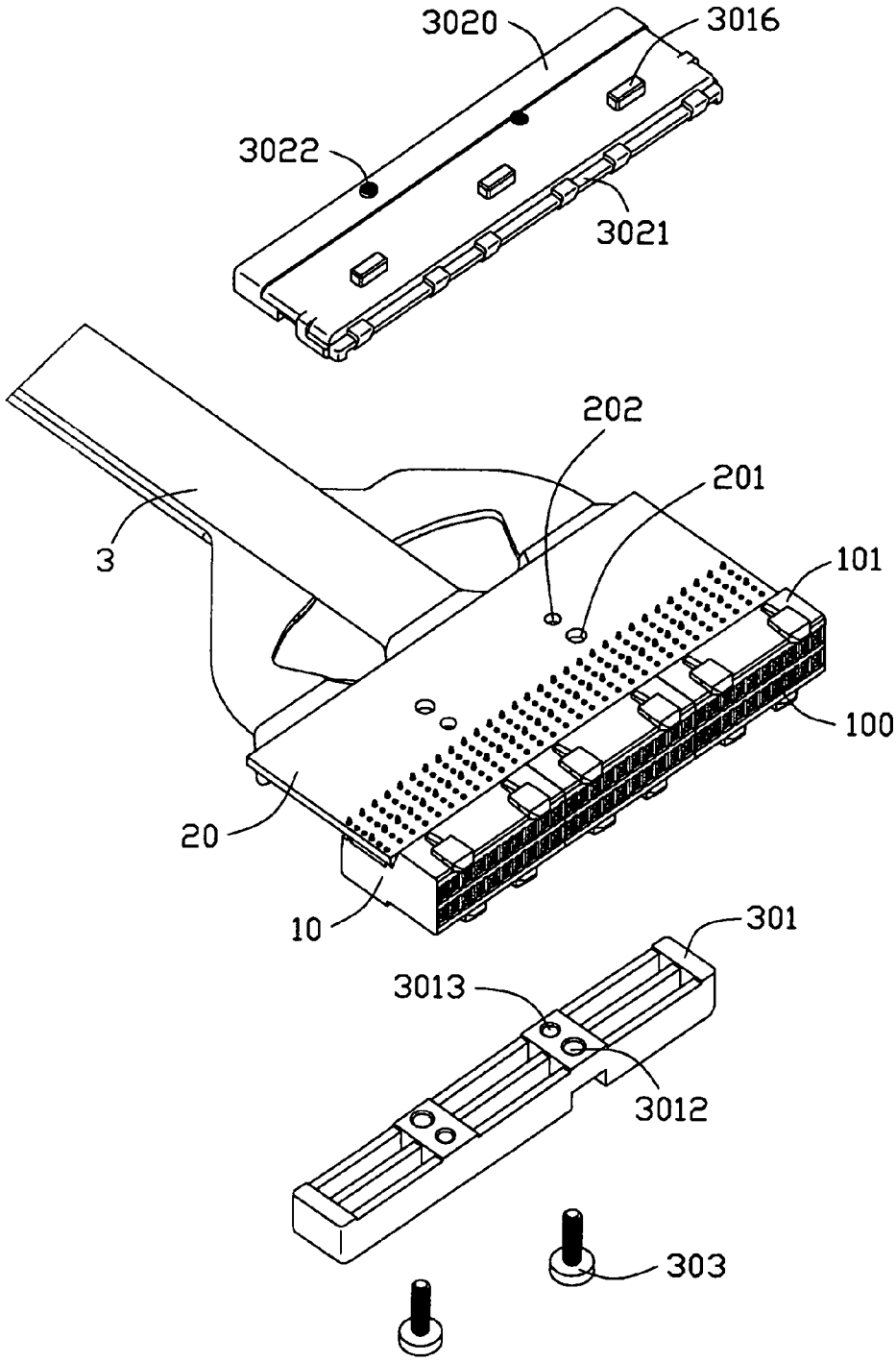
FIG. 4 is a view similar to FIG. 3, but viewed from another aspect.
Figure 5:
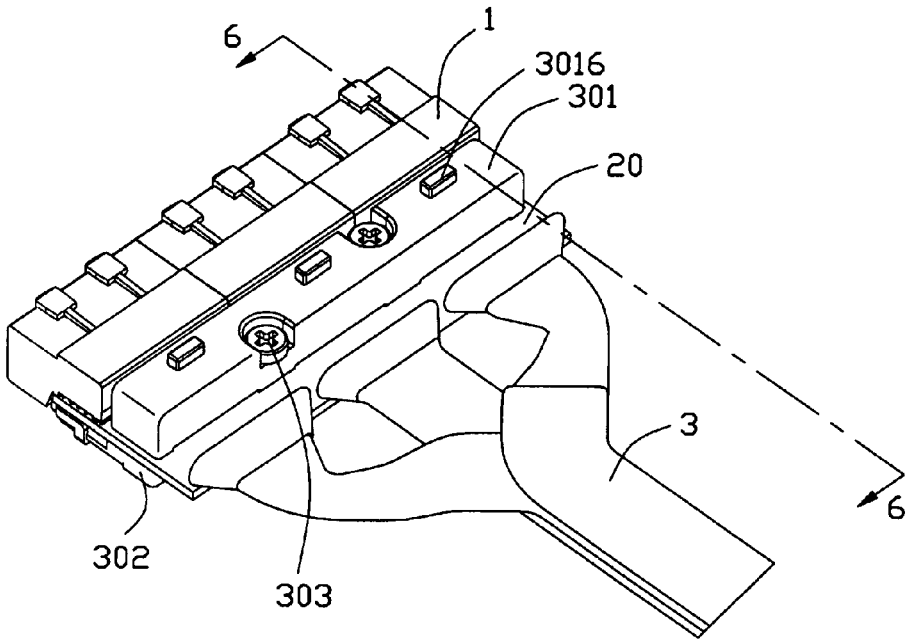
FIG. 5 is an assembled view of FIG. 3.
Figure 6:
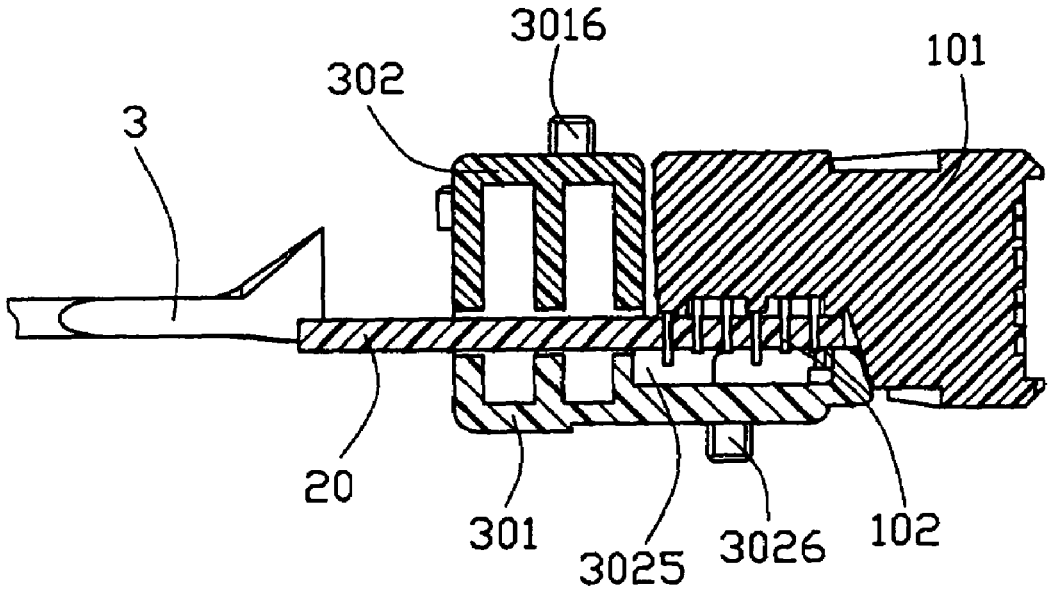
FIG. 6 is a cross-sectional view of FIG. 5 taken along line 6—6.

Referring to FIG. 1 and FIG. 2, an electrical adapter 500 in accordance with the present invention comprises a first connecting part 1 defining a first mating port 100 (FIG. 4), a second connecting part 2 defining a second mating port 200, cable means 3 having a plurality of conductors (not shown) electrically connected to the first and the second connecting parts 1, 2, and a shielding cover 4 enclosing the cable means 3, and the first and the second connecting parts 1, 2 with the first and the second mating ports 100, 200 accessible to corresponding counter parts. Particularly, in present embodiment, the first mating port 100 is complied with ERmet ZD® standard, and the second mating port 200 is complied with InfiniBand® standard.

Referring to FIGS. 3–6, the first connecting part 1 comprises a first connecting module 10, a circuit substrate 20 having circuit traces (not shown) thereon electrically connecting to the first connecting module 10 and a die casting reinforcing member (not labeled) assembled to the circuit substrate 20. The first connecting module 10 is formed of an insulative housing 101, a plurality of terminals 102 disposed in the housing 101 with tail portions (not labeled) extending beyond the housing 101 so as to electrically solder to one end of the circuit substrate 20 in a through hole manner. Cable means 3 is electrically connected to another end of the circuit substrate 20. A pair of first positioning holes 201 and a pair of second positioning holes 202 are defined in an area between the two ends of the circuit substrate 20. Moreover, diameter of the first positioning hole 201 is larger than that of the second positioning hole 202.

The reinforcing member is die cast in metallic material and is composed of a first half 301 and a second half 302 combinable with the first half 301. In the present embodiment, the first half 301 and the second half 302 are combined with each other by a pair of screws 303 with the circuit substrate 20 sandwiched therebetween. The second half 302 has a width larger than that of the first half 301 and comprises a front portion 3020, a rear portion 3021 has a width equal to that of the first half 301 and a depression 3025 defined between the front and the rear portions 3020, 3021. The first half 301 and the rear portion 3021 respectively define a pair of screw holes 3012 corresponding to the pair of first positioning holes 201 for permitting the screws 303 passing therethrough. The rear portion 3021 forms a pair of positioning posts 3023 in alignment with the pair of second positioning holes 202. The first half 301 defines a pair of receiving grooves 3013 for receiving the positing posts 3023 of the second half 302. Both the first and the rear portions 301, 3021 comprise three fixing protrusions 3016 on outer surfaces thereof. Particularly referring to FIG. 6, soldering dots of the terminals 102 and the circuit substrate 20 are completely received in the depression 3025 of the second half 302 as well as not in contact with a bottom surface of the depression 3025, thus, electrical connection of the first connecting module 10 and the circuit substrate 20 is well protected by the second half 302 of the reinforcing member without apprehension of short circuit. As the circuit substrate 20 is constrained by the first and the second halves 301, 302 assembled thereto, when the first connecting part 1 is mated/unmated with the complementary connector, the circuit substrate 20 is unlikely to be shifted by force exerted on the first connecting part during mating/unmating, that is, the connection between the circuit substrate 20 and the first connecting module 10 is more reliable relative to conventional backplane connector.

Figure 7:
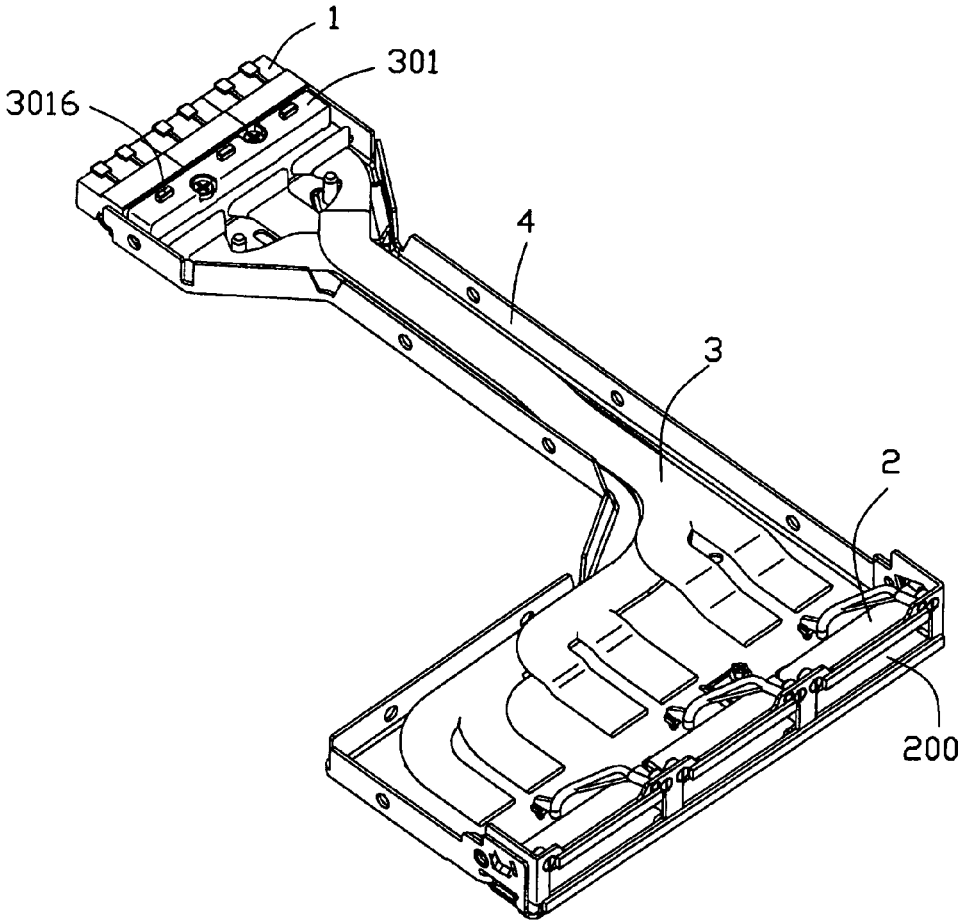
FIG. 7 is a partially assembled view of FIG. 1.
Figure 8:
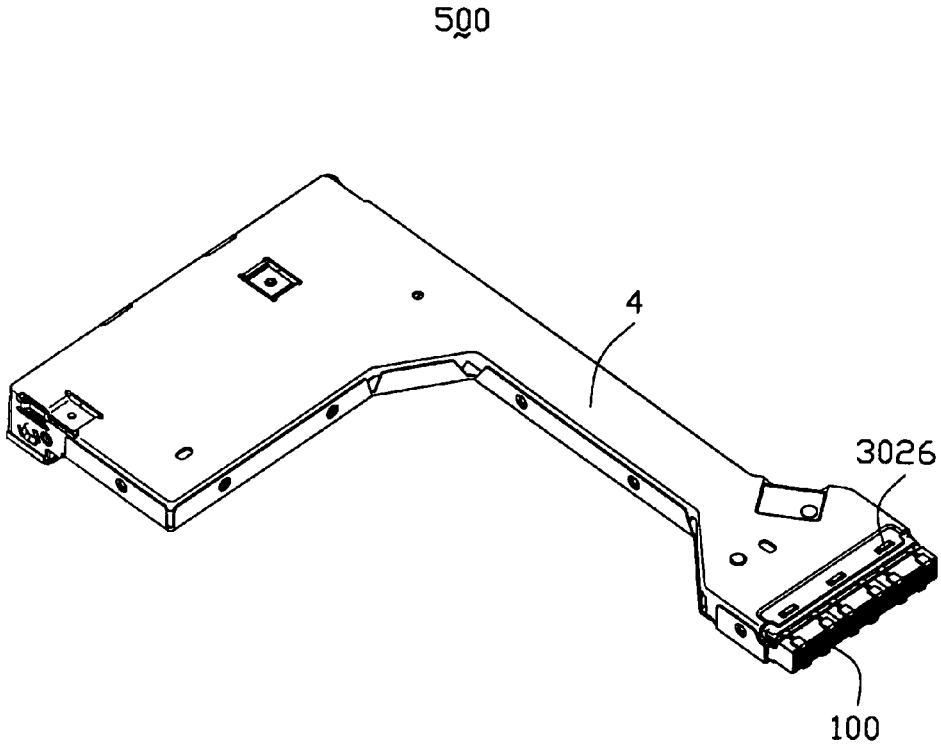
FIG. 8 is an assembled, perspective view of the electrical adapter shown in FIG. 1.

Referring to FIGS. 1–6 and in conjunction with FIGS. 7–8, the cover 4 is formed of an upper cover 40 and a lower cover 41. The upper cover 40 and the lower cover 41 are combined together to form a cavity (not labeled) receiving the first and the second connecting parts 1, 2 and the cable means 3 therein. In present embodiment, as the first connecting part 1 and the second connecting part 2 are of different types, which are complied with different standard, the second mating port 200 has a longitudinal dimension larger than that of the first mating port, the cover 4 is thus configured in L-shaped. Besides, the upper and the lower covers 40, 41 respectively define a plurality of locating holes 400 for engaging with corresponding fixing protrusions 3016 of the reinforcing member.

The invention is to provide an L-like configuration of the shielding cover enclose the connectors for mating with complementary connectors in an offset manner rather than a symmetrical manner under a condition that the longitudinal dimension of one connector is larger than that of the other one. Moreover, the cables are overlapped with one another to narrow the width of the shielding cover in the middle portion while spread around the joint portions with the corresponding connectors for connection.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical adapter adapted for high-speed transmission, comprising:

a first connector part defining a first mating port;

a second connector part defining a second mating port different from the first mating port;

a circuit substrate having circuit traces thereon electrically connecting to the first and the second mating ports; and a reinforcing member assembled to the circuit substrate so as to provide mechanical constrain for mating or unmating of one of the first and the second connector parts;

wherein the reinforcing member is composed of a first half and a second half combinable with the first half, and wherein the circuit substrate is sandwiched between the first and the second halves.

2. The electrical adapter as claimed in claim 1, wherein at least one screw member is provided to fix the reinforcing member to the circuit substrate.

3. The electrical adapter as claimed in claim 1, wherein the reinforcing member is die cast in metallic material.

4. The electrical adapter as claimed in claim 1 further comprising a shielding cover defining a cavity disposing the first and the second connector parts therein with the first and the second mating ports accessible.

5. An electrical adapter comprising:

opposite first and second connectors, each of said first and second connector defining a mating direction and a longitudinal direction perpendicular to said mating direction;

plural sets of cables located between said first and second connectors;

a printed circuit board mechanically and electrically connected between the cables and the first connector;

a metallic shielding cover including upper and lower halves commonly enclosing said first connector, said second connector and said cables;

an upper space formed between the upper half and the printed circuit board, and a lower space formed between the lower half and the printed circuit board; and upper and lower reinforcing members respectively occupying the upper space and the lower space, and essentially engage the upper half and the lower half, respectively.

6. The electrical adapter as claimed in claim 5, wherein said upper and lower reinforcing members commonly sandwich the printed circuit board therebetween with a securing device to fasten said upper and lower reinforcing members together.

7. The electrical adapter as claimed in claim 6, wherein said securing device further extends through said printed circuit board.

8. The electrical adapter as claimed in claim 7, wherein said securing device is either a screw or a pin.

* * * * *